US007530559B2

(12) United States Patent
Movaghar et al.

(10) Patent No.: US 7,530,559 B2
(45) Date of Patent: May 12, 2009

(54) BOOKLET MAKER

(75) Inventors: Abdolreza Movaghar, San Diego, CA (US); Miquel Boleda Busquets, San Diego, CA (US); Eng Long Goh, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 231 days.

(21) Appl. No.: 11/402,424

(22) Filed: Apr. 12, 2006

(65) Prior Publication Data

US 2007/0241492 A1 Oct. 18, 2007

(51) Int. Cl.
*B65H 37/04* (2006.01)

(52) U.S. Cl. ..... 270/32; 270/37; 270/58.07; 270/58.08; 270/58.09; 270/58.12

(58) Field of Classification Search ..... 270/32, 270/37, 58.07, 58.08, 58.09, 58.12
See application file for complete search history.

(56) References Cited

U.S. PATENT DOCUMENTS

| | | | | |
|---|---|---|---|---|
| 4,270,742 | A | 6/1981 | Kobayashi | |
| 4,760,751 | A * | 8/1988 | Kasamatsu | 74/354 |
| 4,901,994 | A | 2/1990 | Ishiguro et al. | |
| 4,936,695 | A * | 6/1990 | Ishii | 400/605 |
| 4,967,239 | A * | 10/1990 | Sakakura | 399/75 |
| 5,078,376 | A * | 1/1992 | Yamada et al. | 270/58.09 |
| 5,196,083 | A * | 3/1993 | Baker et al. | 156/364 |
| 5,213,426 | A * | 5/1993 | Ewing | 400/624 |
| 5,377,965 | A | 1/1995 | Mandel et al. | |
| 5,419,543 | A * | 5/1995 | Nakamura et al. | 271/9.01 |
| 5,501,442 | A | 3/1996 | Mandel | |
| 5,854,696 | A * | 12/1998 | Yun | 358/498 |
| 5,876,027 | A | 3/1999 | Fukui et al. | |
| 5,937,262 | A * | 8/1999 | Cho | 399/401 |
| 5,954,326 | A * | 9/1999 | Gaarder et al. | 271/9.02 |
| 6,059,711 | A | 5/2000 | Wang | |
| 6,156,147 | A | 12/2000 | Spitler | |
| 6,341,010 | B1 * | 1/2002 | Kurosawa | 355/75 |
| 6,354,059 | B1 | 3/2002 | Yoshie et al. | |
| 6,361,036 | B1 * | 3/2002 | Nakazawa | 270/58.07 |
| 6,367,994 | B2 * | 4/2002 | Oshima et al. | 400/185 |
| 6,526,256 | B2 | 2/2003 | Yoshie et al. | |
| 6,568,668 | B1 | 5/2003 | Wakabayashi et al. | |
| 6,712,349 | B2 * | 3/2004 | Watanabe | 270/37 |
| 6,732,603 | B1 * | 5/2004 | Hsu et al. | 74/354 |
| 6,765,698 | B1 * | 7/2004 | Ha | 358/474 |
| 6,793,210 | B2 * | 9/2004 | Sato | 270/37 |
| 6,817,605 | B1 | 11/2004 | Bohn | |
| 6,889,971 | B2 | 5/2005 | Tamura et al. | |
| 2002/0033569 | A1 | 3/2002 | Watanabe | |
| 2003/0219294 | A1 * | 11/2003 | Yoshimura et al. | 399/408 |
| 2004/0021266 | A1 * | 2/2004 | Mizuta et al. | 271/303 |
| 2004/0099090 | A1 * | 5/2004 | Hsu et al. | 74/665 GA |
| 2004/0113348 | A1 * | 6/2004 | Awano | 270/58.07 |
| 2005/0025523 | A1 * | 2/2005 | Iwasaki et al. | 399/167 |
| 2005/0225021 | A1 | 10/2005 | Yamada et al. | |
| 2006/0017218 | A1 * | 1/2006 | Kawata et al. | 271/207 |

FOREIGN PATENT DOCUMENTS

| | | | |
|---|---|---|---|
| EP | 38942 | A1 * | 11/1981 |
| EP | 0748756 | | 12/1996 |
| EP | 0992365 | | 4/2000 |

OTHER PUBLICATIONS

International Search Report dated Oct. 15, 2007.

* cited by examiner

*Primary Examiner*—Gene Crawford
*Assistant Examiner*—Leslie A Nicholson, III

(57) ABSTRACT

Various embodiments and methods relating to a booklet maker are disclosed.

19 Claims, 6 Drawing Sheets

BOOKLET MAKER

BACKGROUND

Information may sometimes be presented in the form of the booklet. Some existing devices for forming booklets are complex, space consuming and expensive.

DETAILED DESCRIPTION OF THE EXAMPLE EMBODIMENTS

Figure 1:
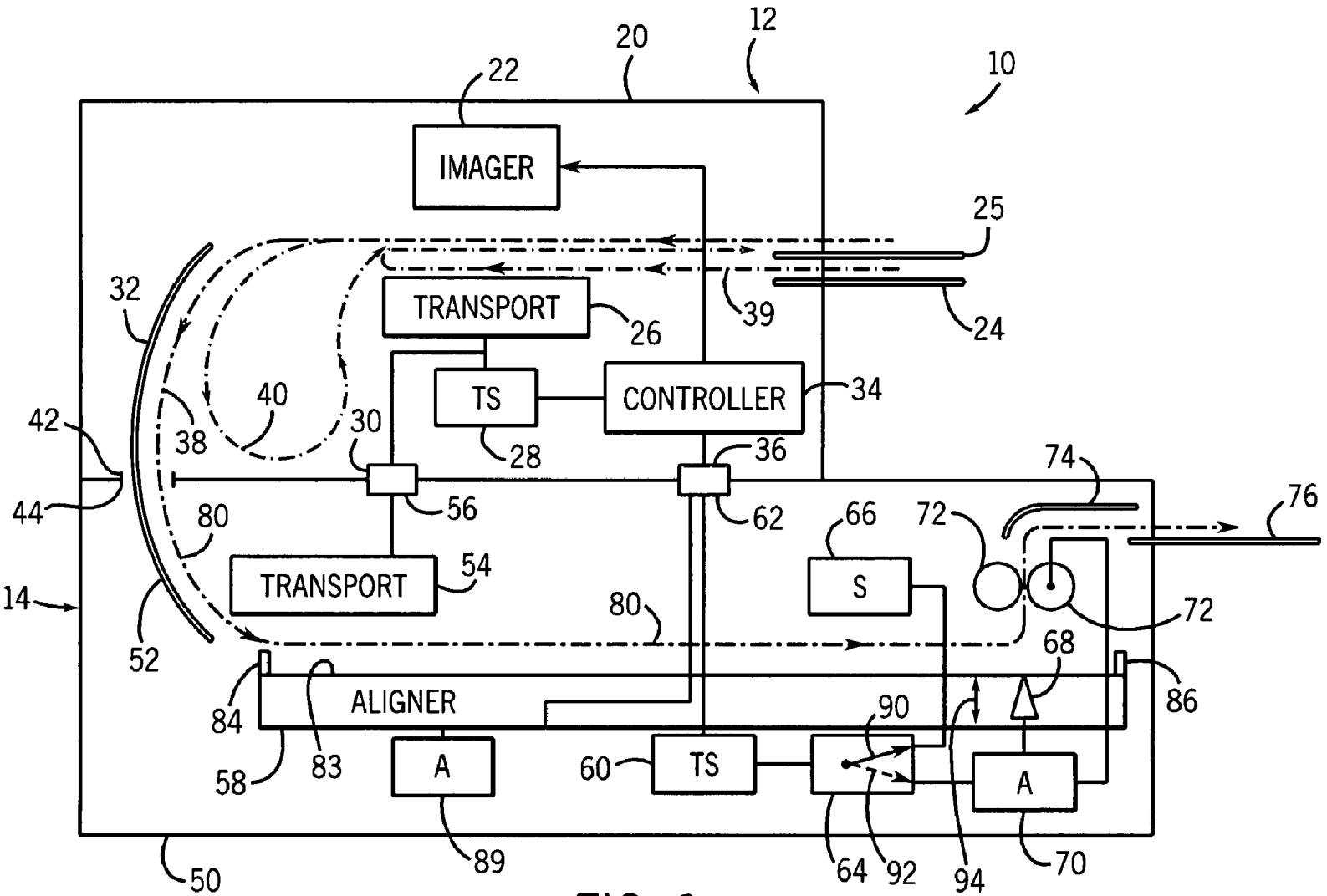
FIG. 1 is a schematic illustration of one example of a booklet forming system according to example embodiment.

FIG. 1 schematically illustrates one example of booklet forming system 10 according to an example embodiment. Booklet forming system 10 is configured to form images on multiple sides or faces of sheets of media, to stack such sheets, to fasten such sheets together and to fold such sheets so as to form one or more booklets. In the example illustrated, system 10 generally includes image-forming device 12 and booklet maker 14.

Image-forming device 12 comprises a device configured to form or print images on multiple sides or faces of sheets of media. Image-forming device 12 generally includes housing 20, imager 22, input 24, output 25, transport 26, torque source 28, torque coupler 30, director 32, controller 34 and communication coupler 36. Housing 20 comprises one or more structures configured to enclose or at least partially surround components of image-forming device 12. Housing 20 may have a variety of different shapes, sizes and configurations. Housing 20 interconnects and maintains imager 22, input 24, transport 26, torque source 28, coupler 30, director 32, controller 34 and coupler 36 as a self-contained unit.

Imager 22 comprises a device configured to form images upon a sheet of media such as sheets of cellulose-based material, polymer-based material or combinations thereof. In one embodiment, imager 22 comprises an ink jet printing device. In yet other embodiments, imager 22 comprises an electrophotographic image-forming device such as a laser printer. In still other embodiments, imager 22 may comprise other presently developed or future developed image-forming devices.

Input 24 comprises one or more structures configured to facilitate input of sheets of media into image-forming device 12. In one embodiment, input 24 comprises one or more trays or bins configured to store and facilitate picking of sheets of media by media transport 26. Although media input 24 is schematically illustrated as being substantially horizontal, in other embodiments media input 24 may alternatively be inclined or vertical. Output 25 comprises one more structures configured to receive sheets of media that have been printed upon by image forming device 12. If two sided or duplex printing is being performed, output 25 may temporarily receive such printed upon sheets prior to such sheets being once again moved to relative to imager 22 for printing on a second side. In embodiments where system 10 is dedicated to booklet forming and does not provide for simplex or duplex printing without using booklet maker 14, output 25 may be omitted.

Media transport 26 comprises one or mechanisms configured to engage and move sheets of media from input 24, relative to imager 22 and along a media path 38 to booklet maker 14. As schematically shown by media path 39, transport 26 initially moves media along a simplex or one-sided printing path 39 from input 24 across imager 22 and back towards output 25. As schematically illustrated by media flow path 40, if duplex printing (two-sided printing) without forming the sheets into booklets is desired or if duplex printing and booklet making is desired, media transport 26 is further configured to return the sheets having printing on a first side back along duplex path 40 for printing on a second side. If booklet making is desired, media transport 26 additionally transports such sheets now printed upon both sides along booklet making path 38. In one embodiment, transport 26 comprises one or more rollers, belts, diverter and the like configured to duplex sheets of media. In the embodiment illustrated, image-forming device 12 includes duplexing components within housing 20. In other embodiments, image-forming device 12 may omit duplexing opponents, wherein the duplexing components are provided as a separate modular unit connectable to image-forming device 12.

Torque source 28 comprises a source of torque operably coupled to media transport 26 so as to rotatably drive one or more components of media transport 26. In one embodiment, torque source 28 may comprise a motor configured to supply torque to the one or more rollers or belts of media transport 26. Such torque may additionally used to actuate one or more diverter's (not shown) to selectively divert media from path 38 to path 40 for duplexing.

Torque coupler 30 comprises one or more structures configured to transmit torque from image-forming device 12 to booklet maker 14. Torque coupler 30 is positioned along a perimeter or extremity of housing 20 so as to mate with a corresponding torque coupler of booklet maker 14. In the particular embodiment illustrated, torque coupler 30 comprises a gear operably coupled to torque source 28 via a gear train, wherein the gear is configured to be placed in meshing engagement with another gear of booklet maker 14 to facilitate transmission of torque. In other embodiments, torque coupler 30 may comprise one or more belts or other structures configured to transmit torque to booklet maker 14.

Director 32 comprise one or more structures within housing 20 configured to form media path 38 (schematically illustrated with broken lines). As shown by FIG.1, media path 38 guides sheets of media through an output opening 42 of image-forming device 12 and into an input opening 44 of booklet maker 14. In the particular example illustrated, booklet maker 14 is configured to be positioned below image-forming device 12. As a result, director 32 at least partially forms media path 38 such that sheets of media are directed in a substantially vertical direction from image-forming device 12 to an underlying booklet maker 14. In one embodiment, image-forming device 12 is a stand-alone unit, wherein booklet maker 14 is removably mounted to a bottom of image-forming device 12. As a result, the overall footprint an image forming device 12 is not substantially increased with the addition of booklet maker 14. The modularity of image-forming device 12 and booklet maker 14 facilitate upgrading of image-forming device 12 to booklet making capability as needed. In yet other embodiments, booklet maker 14 may alternatively be configured to be removably coupled to image-forming device 12 at other positions relative to image-forming device 12 such as along a side, front or rear of image-forming device 12 or along a top of image-forming device 12. In some embodiments, image-forming device 12 and booklet maker 14 alternatively be contained within a single unitary housing.

Controller 34 comprises one or more processing units configured to generate control signals directing torque source 28 and imager 22. In the example illustrated, controller 34 further generates control signals directing the operation of booklet maker 14. For purposes of this disclosure, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 34 is not limited to any specific combination of hardware circuitry and software, nor to any particular source for the instructions executed by the processing unit.

Communication coupler 36 comprises one or more devices configured to facilitate indication between image-forming device 12 and booklet maker 14. In particular, communication coupler 36 comprises a device configured to transmit control signals generated by controller 34 to booklet maker 14. In one embodiment, communication coupler 36 may comprise a connector or plug located along an exterior of housing 20, wherein electrical signals are transmitted to a corresponding connector or a plug along a perimeter of booklet maker 14. In yet other embodiments, communication coupler 36 may comprise other devices configured to transmit communication signals such as optical signals, infrared signals and wireless or radio frequency signals to booklet maker 14.

Booklet maker 14 comprises a device configured to receive printed upon sheets from image-forming device 20, to align such sheets, to fasten such sheets and to fold such sheets into one or more booklets. Booklet maker 14 generally includes housing 50, director 52, media transport 54, torque coupler 56, aligner 58, torque source 60, communication coupler 62, torque switching mechanism 64, fastener 66, folding blade 68, actuator 70, folding rollers 72, output director 74 and output 76. Housing 50 comprises one or more structures configured to at least partially enclose or surround remaining components of booklet maker 14. Housing 50 maintain such components as a single modular unit configured to be releasably connected to image-forming device 20. As noted above, housing 50 includes an input opening 44 configured to align with output opening 42 of housing 20 when booklet maker 14 is joined to image-forming device 12. In other embodiments, in lieu of being modular, image forming device 12 and booklet maker 14 may be joined as a single structural unit, wherein housing 20 and housing 50 are not distinct from one another.

Director 52 comprises one or more structures configured to direct media received through input opening 44 of housing 50 into booklet maker 14. Director 52 at least partially forms a media path 80 guiding sheets of media to media transport 54. Although illustrated as being arcuate, director 52 may have various shapes and configurations.

Media transport 54 comprises one or more structures or mechanisms configured to engage and move sheets of media received from image-forming device 20 and to transport such receive sheets of media to aligner 58. In one embodiment, transport 54 comprises one or more rollers. In still other embodiments, transport 54 comprises one or more belts, starwheels and the like.

Torque coupler 56 comprises one or more components configured to cooperate with torque coupler 30 along a perimeter or exterior of housings 20 and 50 so as to receive torque from torque coupler 30 and to transmit such torque to transport 54. Because torque coupler 56 cooperate with torque coupler 30 to transmit torque from torque source 28 of image-forming device 12 to transport 54 of booklet maker 14, booklet maker 14 may be provided with fewer torque sources, such as motors, reducing the size, complexity and cost of booklet maker 14. In one embodiment, torque coupler 56 may comprise a gear of a gear train operably coupled to transport 54 and configured to mesh with a corresponding gear of torque coupler 30. In other embodiments, torque coupler 56 may comprise other torque transmitting structures such as a belt or may be omitted where booklet maker 14 has a torque source for driving media transport 54.

Aligner 58 comprise a mechanism configured to align edges of multiple received sheets of printed upon media into a stack ready for fastening and folding. In the embodiment illustrated, aligner 58 further transports the formed stack of sheets to a fastening positioned and a folding position. Aligner 58 includes floor 83, a pair of opposing alignment surfaces 84, 86 and an actuator 89. Floor 83 comprises a bed or other surface on which sheets rest while being aligning and stacked. Floor 83 also serves as a supporting surface while the formed stack of sheets is moved by surface 84 two a fastening positioned and a folding position. Although floor 83 is illustrated as a substantially stationary surface, in other embodiments, floor 83 may comprise a band or one or more belts supporting the stack of sheets and configured to move the stack of sheets to the fastening position and the folding position. In such an embodiment, alignment surface 84 may not move the formed stack to such positions, reducing the distance that alignment surfaces 84 and 86 must travel.

As will be described in detail hereafter, actuator 89 is operably coupled to one or both of alignment surfaces 84 and 86 and is configured so as to move one or both of alignment surfaces 84, 86 with respect to one another to align edges of sheets of media. In one embodiment, actuator 89 may comprise one or more electric solenoids. In other embodiments, actuator 89 may comprise other devices configured to linearly move surfaces 84 and 86. For example, in other embodiments, actuator 89 may comprise hydraulic or pneumatic cylinder-piston assemblies or a rotary actuator, such as a motor, appropriately linked to surfaces 84 and 86 so as to convert torque provided by the rotary actuator into linear motion of surfaces 84 and 86. In yet other embodiments, actuator 89 may be omitted where one or both of surfaces 84 and 86 are driven by torque source 60. In particular embodiments, aligner 58 may include an additional pair of opposing alignment surfaces (not shown) in addition to alignment surfaces 84 and 86 and movable relative to one another so as to align other edges of sheets of media.

Torque source 60 comprises a mechanism configured to supply torque for driving fastener 66 and actuator 70 which drives folding blade 68 and a folding rollers 72. In one embodiment, torque source 60 comprises a motor operably coupled to its driven components by one or more gear trains. Torque source 60 may alternatively be operably coupled to its driven components by one or more belt and pulley arrangements, chain and sprocket arrangements or other power transmitting arrangements.

Communication coupler 62 is similar to communication coupler 36. Communication coupler 62 is configured to receive communication signals generated by controller 34 and transmitted by coupler 36. Communication coupler 62 is further configured to transmit such signals to torque source 60 and actuator 89, facilitating control of torque source 60 and actuator 89 by controller 34. As a result, the operation of image-forming device 12 and booklet maker 14 may be coordinated by the controller of image-forming device 20. Because in the operation of booklet maker 14 is controlled by controller 34 of image-forming device 12, the number of controllers or processing units of booklet maker 14 may be reduced, reducing the complexity, size and cost of booklet maker 14. In other embodiments, booklet maker 14 may have its own controller.

Torque switching mechanism 64 comprises one of more structures forming a mechanism configured to selectively transmit torque from torque source 60 to either fastener 66 or actuator 70. In one embodiment, mechanism 64 moves between a first position (schematically illustrated by arrow 90) in which torque is transmitted to fastener 66 and a second position (schematically illustrated by broken arrow 92 in which torque is selectively transmitted to actuator 70. Because switching mechanism 64 facilitates use of a single torque source 60 four powering of fastener 66 and actuator 70, booklet maker 14 is more compact, is less complex and is less expensive.

Fastener 66 comprises a mechanism configured to fasten and join multiple printed upon sheets together. In the embodiment illustrated, fastener 66 comprises a stapler, which upon being rotated against a stack of sheets, drives fastening members such as staples through the sheets. In other embodiments, fastener 66 may comprise other fastening devices.

Folding blade 68 comprises a member configured to engage a face of a stack of media and to move the stack of media into and between the nip of folding rollers 72. In the embodiment illustrated, folding blade 68 reciprocates in a substantially vertical direction as indicated by arrows 94. In other embodiments, folding blade 68 may alternatively reciprocate in other directions depending upon the orientation of folding rollers 72.

Actuator 70 comprising mechanism configured to utilize torque received from torque source 60 so as to reciprocate folding blade 68 in the directions indicated by arrows 94. Actuator 70 is further configured to transmit torque received from torque source 60 folding rollers 72 so to rotate folding roller 72. In one embodiment, actuator 70 may comprise an arrangement of gears configured to transmit torque to folding rollers 72 and an eccentrically mounted link connected to one of the gears and folding blade 68 to reciprocate folding blade 68. In other embodiments, actuator 70 may have other configurations.

Folding roller 72 comprise one or more rollers opposing one another so as to form a nip. In one embodiment, one or both of rollers 72 may be configured to be rotatably driven by actuator 70 or another rotary actuator. In still other embodiments, rollers 72 may alternatively not be rotatably driven, wherein the reciprocation of folding blade 68 drives the stack of sheets between rollers 72 which results in rotation of rollers 72.

Director 74 comprises one more structures configured to engage the folded sheet of media or booklet so as to turn the booklet 90 degrees. In the example illustrated, folding blade 68 reciprocates in a substantially vertical direction and director 74 turns the resulting booklet such that the resulting booklet is ejected in a substantially horizontal direction to output 76 which comprises a tray, bin or another media manipulation device. As a result, sheets of media are moved through booklet maker 14 while in substantially a single horizontal orientation, reducing a height of booklet maker 14. As indicated by media path 80, sheets of media are substantially horizontal when being aligned, when being moved from aligner 58 to fastener 66, when being fastened by fastener 66, when being moved from fastener 66 to a position across from folding blade 68 and when being ejected to output 76. Because the sheets of media are substantially in one orientation during a majority of treatment by booklet maker 14, booklet maker 14 may have a reduced height.

FIGS. 2-9 schematically illustrate the forming of a booklet according to one example method. FIGS. 2-9 illustrate the formation of booklet using system 10. The method illustrated in FIGS. 2-9 may alternatively be carried out by another booklet forming system.

Figure 2:
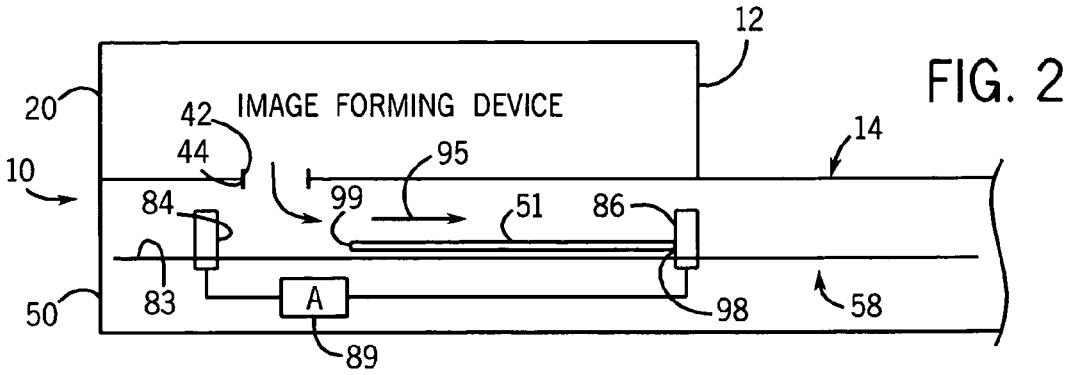
FIGS. 2-5 are schematics illustrating a booklet maker of the system of FIG. 1 forming a stack of multiple sheets according to one example embodiment.

FIG. 2 illustrates the reception of a first sheet SI by booklet maker 14 from image-forming device 12. In one embodiment, actuator 89 in response to control signals from controller 34 (shown in FIG. 1) moves alignment surface 84 in the direction indicated by arrow 95 such that surface 84 engages a rearward or trailing edge 99 of sheet S1 so as to move sheet S1 in the direction indicated by arrow 95 until sheet S1 is sufficiently disengaged from transport 54. In one embodiment, surface 84 moves sheet S1 until leading edge 98 abuts surface 86. In still other embodiments, transport 54 may be configured to receive sheet S1 from transport 26 of image-forming device 12 and to itself disengage sheet S1 once sheet S1 is positioned on aligner 58.

As further shown by FIG. 2, once sheet S1 is positioned upon aligner 58 between surfaces 84 and 86, actuator 89 positions alignment surface 84 rearward of the location at which leading edges 98 of sheets being received from image-forming device 12 initially contact floor 83 of aligner 58. As a result, alignment surface 84 does not interfere with reception of subsequent sheets from image-forming device 12. In other embodiments, alignment surface 84 may be positioned rearward of the location at which leading edges 98 of sheets being received from image-forming device 12 initially contact the floor 83 during reception of sheets such that actuator 89 does not move surface 84 to ready aligner 58 for reception of the subsequent sheet. In the example illustrated, actuator 89 positions alignment surface 84 rearward of input opening 44 of booklet maker 14.

Figure 3:
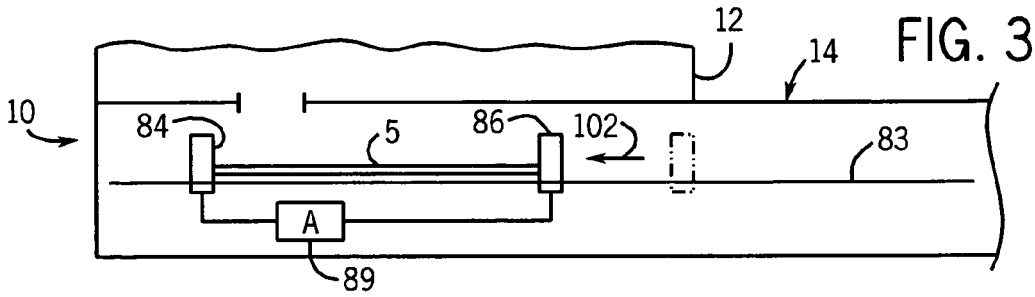

FIG. 3 schematically illustrates aligner 58 positioning sheet S1 to ready aligner 58 for the reception of a subsequent sheet. As shown by FIG. 3, actuator 89 moves alignment surface 86 from a forward position (shown in broken lines) in the direction indicated by arrow 102 towards surface 84 to the position shown in solid lines in which trailing edge 99 of sheet S1 is a rearward of the location at which leading edge 98 of sheets being received from image-forming device 12 initially contact floor 83. In one embodiment, surface 86 is moved in the direction indicated by arrow 102 until trailing edge 99 abuts surface 84. Because trailing edge 99 is moved to a location rearward of the location at which leading edge 98 of sheets being received from image-forming device 12 initially contact floor 83, trailing edge 99 of sheet S1 does not interfere with the reception of subsequent sheets from image-forming device 12 by potentially contacting the leading edge 98 of subsequent sheets being received.

Figure 4:
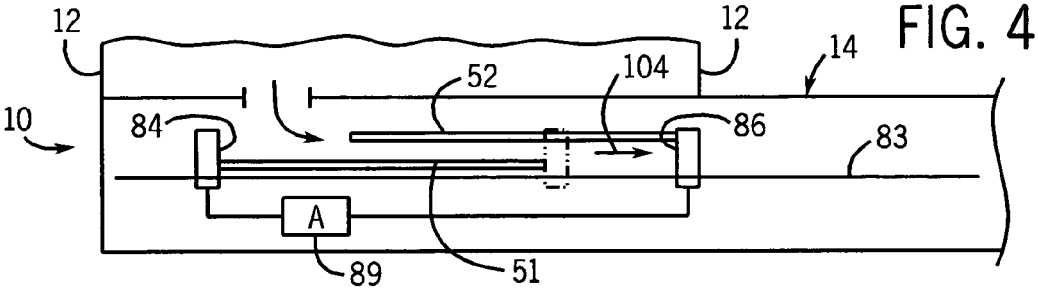

FIG. 4 schematically illustrates reception of a second sheet S2 by booklet maker 14. Prior to such reception, actuator 89, in response to control signals from controller 34 (shown in FIG. 1) or another controller associated with booklet maker 14, returns alignment surface 86 to the position shown in FIG. 2 as indicated by arrow 104. The reception of sheet S2 is substantially similar to reception of sheet S1 described above. In particular, media transport 54 (shown in FIG. 1) contacts or engages sheet S2 and pulls sheet S2 from image-forming device 12. In one embodiment, actuator 89 once again moves surface 84 in the direction indicated by arrow 104 so as to move both sheet S1 and sheet S2 in the direction indicated by arrow 104 until sheet S2 is sufficiently disengaged from media transport 54. In yet other embodiments, disengagement of sheet S2 from media transport 54 may occur without assistance from alignment surface 84.

Figure 5:
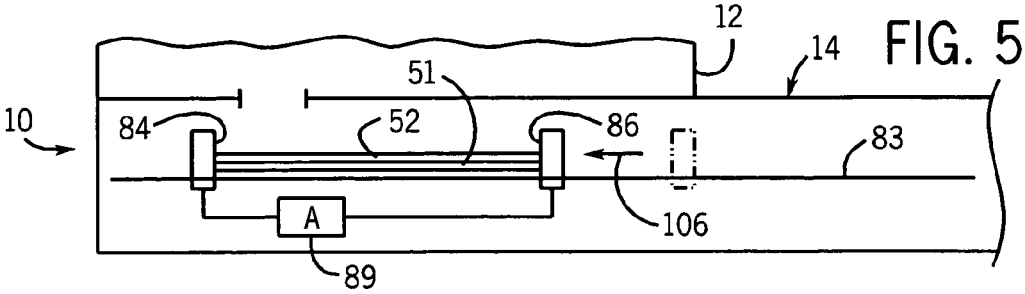

As shown by FIG. 5, actuator 89, in response to control signals from controller 34 (shown in FIG. 1) or another controller associated with booklet maker 14, moves in the direction indicated by arrow 106 to engage leading edge 98 of sheet S2 and to move at least sheet S2 in the direction indicated by arrow 106 until the trailing edge 99 of both sheets S1 and S2 are positioned rearwardly of the location at which leading edges 98 of subsequent sheets being received from image-forming device 12 come into close proximity or contact with floor 83. As a result, the likelihood of the trailing edge 99 of sheet S1 interfering with the reception of subsequent sheets from image-forming device 12 is reduced. Prior to reception of subsequent sheets, actuator 89 once again returns alignment surface 86 to the position shown in either FIG. 1 or FIG. 3.

The general process or method described above for receiving sheets from image-forming device 12 is repeated until the desired number of sheets have been received and aligned between surfaces 84 and 86 of aligner 58. In particular embodiments, aligner 58 additionally includes transverse or side alignment surfaces (not shown) which are driven by actuator 89 (or another actuator) in response to control signals from controller 34 (shown in FIG. 1) or another controller associated with booklet maker 14 so as to align transverse or side edges of sheets of the stack resting upon floor 83.

Figure 6:
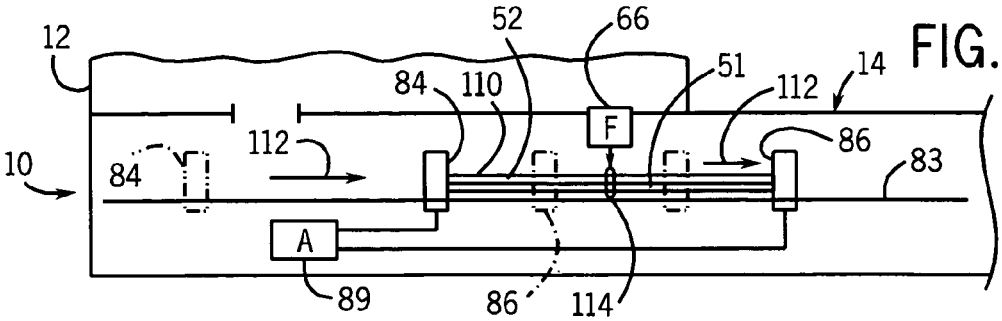
FIG. 6 is a schematic illustrating fastening of the sheets of the stack of FIG. 4 according to one example embodiment.

Once the desired number of sheets have been aligned and positioned upon floor 83 to form a stack 110, the stack 110 is ready for fastening. FIG. 6 schematically illustrates movement of stack 110 to a fastening position. In the example illustrated, actuator 89, in response to control signals from controller 34 or another controller associated with booklet maker 14, moves alignment surfaces 84 and 86 in the direction indicated by arrows 112 to move stack 110 to a fastening position opposite to fastener 66.

In one embodiment, surfaces 84 and 86 are moved in substantial unison and at the same speed while surfaces 84 and 86 are in engagement with edges 99 and 98, respectively, of sheets of stack 110. As a result, the alignment of the sheets of stack 110 is maintained during movement of stack 110 to the fastening position. In other embodiments, surfaces 84 and 86 may be moved at different times and potentially at different speeds during movement of stack 110 to the fastening position shown in FIG. 6.

Once stack 110 is in the fastening position, the sheets of stack 110 are either in alignment with one another or are moved into alignment with one another. In one embodiment, when stack 110 is in the fastening position, fastener 66 is located so as to apply a fastening structure 114 to the sheets of stack 110 at a longitudinal center between edges 99 and 98. In one embodiment, fastening structure 114 may comprise one or more staples. In other embodiments, other fastening structures may be coupled or applied to stack 110 by fastener 66. In yet other embodiments, stack 110 may be positioned by surfaces 84, 86 at other positions such that fastener 66 applies one or more fastening structures 114 to stack 110 at one or more other locations along stack 110 or at additional locations along stack 110.

Fastener 66 applies a fastening structures 114 upon being actuated using torque received from torque source 60 (shown in FIG. 1). During fastening, switching mechanism 64 is actuated to the position shown in solid lines in FIG. 1 such that torque from torque source 60 is transmitted to fastener 66. Once the one or more fastening structures 114 have been applied to stack 110, switch 64 is actuated so as to cease transmitting torque to fastener 66 and to transmit torque from torque source 60 to actuator 70 (as indicated by the arrow 92 in FIG. 1) to be utilized for folding of the fastened stack 110.

Figure 7:
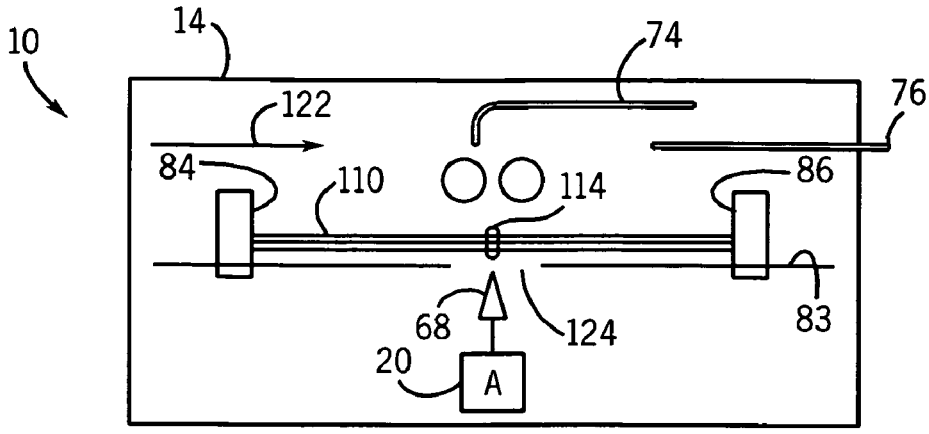
FIGS. 7-8 are schematics illustrating folding of the fastened stack of FIG. 6 to form a booklet according to one example embodiment.
Figure 8:
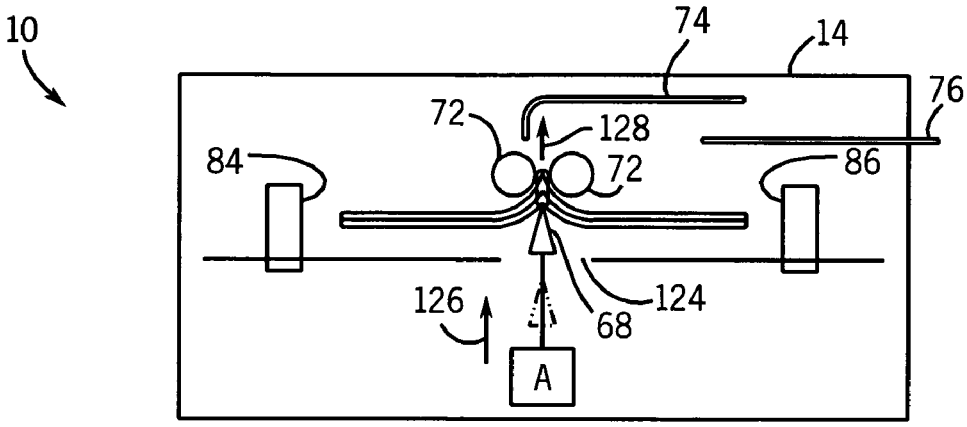
Figure 9:
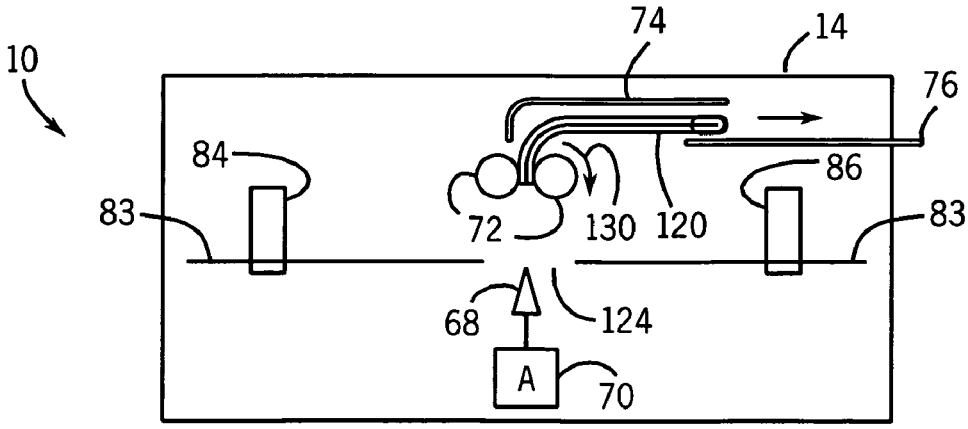
FIG. 9 is a schematic illustrating ejection of the booklet according to one example embodiment.
Figure 10:
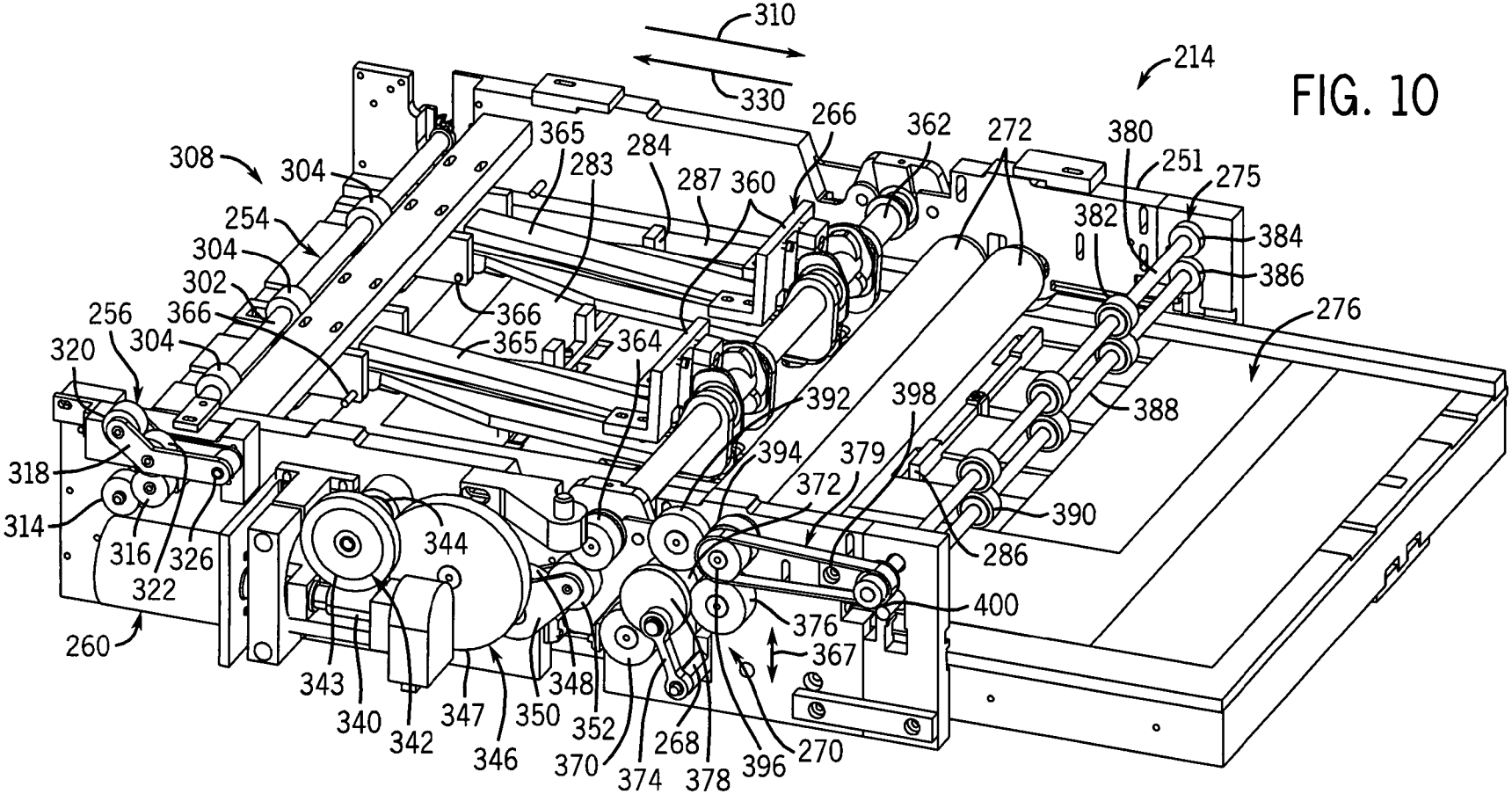
FIG. 10 is a top perspective view of another embodiment of the booklet maker of the system of FIG. 1 according to one example embodiment.
Figure 11:
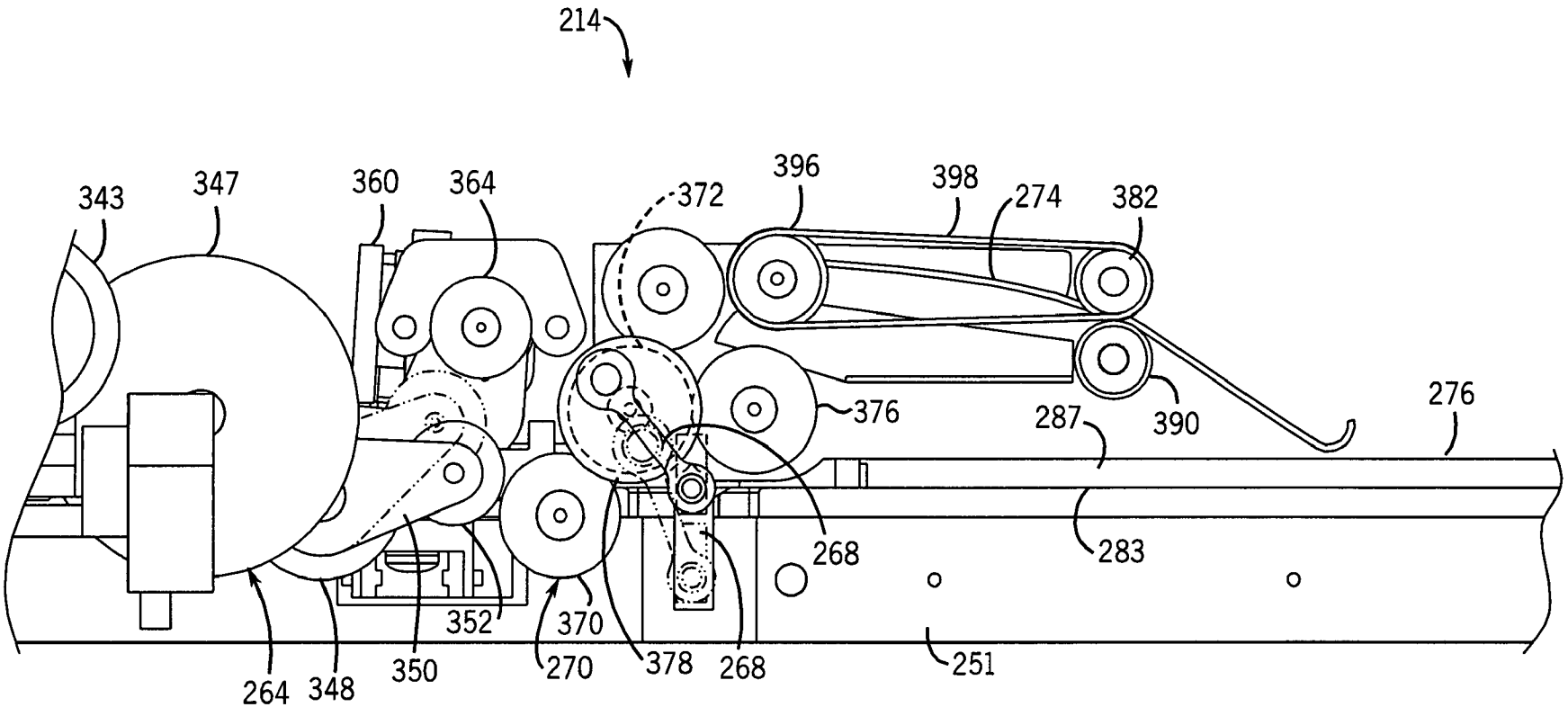
FIG. 11 is a fragmentary side elevational view of the booklet maker of FIG. 10 according to one example embodiment.

FIGS. 7-9 illustrate folding of the fastened stack 110 and ejection of the resulting booklet 120 by booklet maker 14. As shown by FIG. 7, upon application of the one or more fastening structures 114 to stack 110, actuator 89 in response to control signals from controller 34 (shown in FIG. 1) or another controller associated with booklet maker 14 moves alignment surfaces 84 and 86 in the direction indicated by arrow 122 so as to move the fastened stack 110 from the fastening position (shown in FIG. 6) to a folding position (shown in FIG. 7). In one embodiment, surfaces 84 and 86 are moved in substantial unison and at the same speed while surfaces 84 and 86 are in engagement with edges 99 and 98, respectively, of sheets of stack 110. As a result, the orientation of stack 110 is maintained during movement of stack 110 to the folding position. In the example illustrated, edges 98 and 99 of the sheets of stack 110 extend parallel to the axes about which folding rollers 72 rotate. In other embodiments, surfaces 84 and 86 may be moved at different times and potentially at different speeds during movement of stack 110 to the folding position shown in FIG. 7.

Once stack 110 is in the folding position, the edges of the sheets of stack 110 are either parallel with rollers 72 or are reoriented so as to be parallel to rollers 72. In one embodiment, when stack 110 is in the folding position, the nip of folding roller 72 is located so as to receive a longitudinal center between edges 99 and 98. In one embodiment, when stack 110 is in the folding position, the one or more fastening structures are positioned opposite to both the nip of folding roller 72 and folding blade 68.

FIG. 8 schematically illustrates folding of the fastened stack 110. As shown in FIG. 8, actuator 70, upon receiving torque from torque source 60 via switching mechanism 64, actuates folding blade 68 in a substantially vertical direction through an opening 124 in floor 83 towards an underside of stack 10 as indicated by arrow 126. As a result, folding blade 68 moves that portion of stack 110 having fastening structure 114 into the nip between folding rollers 72. During such time, folding rollers 72 are also being rotatably driven by actuator 70. Folding rollers 72 engage stack 110 and begin moving stack 110 in an upward direction as indicated by arrow 128. Upon engagement of stack 110 by folding roller 72, actuator 70 may be retracted to its initial position below floor 83. In some embodiments, blade 68 may remain in its raised position shown in FIG. 7 as stack 110 is being drawn between rollers 72.

FIG. 9 schematically illustrates completion of folding of stack 110 and the ejection of stack 110 as booklet 120. As shown by FIG. 9, rotation of folding rollers 72 in the direction indicated by arrow 130 moves the folded stack upward into engagement with director 74. Director 74 redirects booklet 120 such that booklet 120 turns at approximately 90 degrees such that booklet 120 is ejected to output 76 while at a substantially horizontal or near horizontal orientation. In other embodiments, director 74 may be configured to redirect booklet 120 at other angles. Because director 74 redirects the completed booklet 120 to an orientation substantially parallel to floor 83 (illustrated as being substantially horizontal in the example embodiment), the overall height of booklet maker 14 may be reduced. Although system 10 has been described as including the particular booklet maker 14, in other embodiments, system 10 may include other booklet makers. For purposes of this disclosure, the term "booklet maker" shall mean any device configured to receive printed upon sheets, to align such sheets, to fasten such sheets and to fold such sheets into one or more booklets. For purposes of this disclosure, the term "booklet" shall mean the assembly of two or more sheets which are fastened together and which are folded along one or more folds.

FIGS. 10-14 illustrate booklet maker 214, one example embodiment of booklet maker 14 shown in FIG. 1. As with booklet maker 14, booklet maker 214 is configured to receive printed upon sheets of media from an image forming device, such as image forming device 12. Like booklet maker 14, booklet maker 214 is configured to receive sheets from an overlying image forming device. Booklet maker 214 aligns such received sheets, fastens the aligned sheets and folds the fastened sheets to form a booklet.

Booklet maker 214 generally includes frame 251, transport 254, torque coupler 256, aligner 258, torque source 260, communication coupler 62, torque switching mechanism 264, fastener 266, folding blade 268, actuator 270, director 274, ejector 275 and output 276. Frame 251 comprises one or more structures which join and interconnect the remaining components of booklet maker 214 as a single unit configured to be mounted below an image forming device. Frame 251 may also support an exterior skin or housing (not shown). Frame 251 may have a variety of sizes, shapes and arrangements.

Transport 254 comprises a mechanism configured to engage sheets being received from an overlying or rear image forming device and to move such sheets into position with respect to aligner 258. In the example illustrated, transport 54 comprises an elongate shaft 302 supporting sheet-engaging rollers 304. Shaft 302 is rotatably supported by frame 251 proximate an upper rear end 308 of booklet maker 214. In one embodiment, rollers 304 extend opposite. to an angled or curved structure 309 (shown in FIG. 12). Upon being rotated, rollers 304 frictionally engage a top face of a sheet being received and move the received sheet along the structure 309 in a forward direction as indicated by arrow 310. In other embodiments, transport 254 may alternatively include a pair of shafts supporting a pair of opposite. rollers configured to frictionally engage both faces of a sheet being received. In yet other embodiments, transport 254 may comprise other media engaging structures such as belts and the like.

Torque coupler 256 comprises a structure configured to receive torque from an image forming device and to transmit the torque to transport 254. In the embodiment illustrated, torque coupler 256 includes gear 314, gear 316, carrier 318, gear 320 and gear 322. Gear 314 is coupled to shaft 302 such that rotation of gear 314 also results in rotation of shaft 302. Gear 316 is in meshing engagement with gear 314 and is rotatably supported by frame 251. Gear 316 provides appropriate speed control and rotational direction adjustment. Carrier 318 comprises a pair of arms pivotably supported about axis 326 that support gears 320 and 322. Gear 320 is supported by carrier 318 and is configured to be positioned in meshing engagement with a corresponding gear (not shown) of an image forming device, wherein the gear of the image forming device is rotatably driven by a torque source associated with the image forming device. Gear 322 is rotatably supported by carrier 318 in meshing engagement with gear 320 and gear 316. Gear 322 transmits torque from gear 320 to gear 316 while providing appropriate speed and directional adjustment.

When booklet maker 214 is coupled to an image forming device, torque is received by gear 320 and is transmitted to transport 254 via gears 322, 316 and 314. Because transport 254 utilizes torque from an image forming device, the reception of sheets by maker 214 may be better synchronized with the output of printed upon sheets by image forming device 12. In addition, the complexity, size and cost of booklet maker 214 may be reduced. Although torque coupler 256 is illustrated as including a gear train for transmitting torque to shaft 302, in other embodiments, torque coupler 256 may include other torque transmission arrangements such as belt pulley arrangements, chain and sprocket arrangements and the like.

Aligner 258 aligns received sheets to form a stack. In the embodiment illustrated, aligner 258 further moves the formed stack of sheets to a fastening position and a folding position. Aligner 258 generally includes bed or floor 283, rear alignment surface 284, front alignment surface 286, side datum 287, side alignment surface 288 (shown in FIG. 12) and actuators 89 (shown and described with respect to FIG. 1). Floor 283 comprises a generally flat or horizontal arrangement of one or more surfaces along which a stack of sheet is formed and moved. In one embodiment, floor 283 includes openings through which alignment surfaces 284 and 286 project. In other embodiments, alignment surfaces may alternatively project and extend over floor 283 from the sides, front or rear.

Rear alignment surface 284 comprises an arrangement of inclined or substantially vertical surfaces configured to align and engage a rear edge of one or more sheets of media resting upon floor 283. An example illustrated, alignment surface 284 comprises a plurality of projections or fingers projecting through and above floor 283. Alignment surfaces 284 are configured to linearly move and reciprocate in a forward direction as indicated by arrow 310 or a rearward direction as indicated by arrow 330. Alignment surfaces 284 are movable in a rearward direction to an extent such that alignment surfaces 284 are positioned rearward of a location along floor 283 at which the leading edge of a sheet being received initially engages or comes into close proximity with floor 283. Alignment surfaces 284 are configured to move forwardly to an extent such that surface 284 moves a stack of sheets to both a fastening position and a folding position as described hereafter. In other embodiments in which other stack transfer mechanisms are employed to move the stack, such as rollers, belts and the like, alignment surfaces 284 may be linearly movable to a lesser extent.

Alignment surfaces 286 comprise tabs, fingers or projections extending above floor 283 that are configured to be linearly moved and reciprocated in a forward direction as indicated by arrow 310 or in a rearward direction as indicated by arrow 330. Alignment surfaces 286 are generally located on opposite longitudinal side of Fastener 266 and folding rollers 272 as alignment surfaces 284. Alignment surfaces 286 are configured to engage a frontward or leading edge or edges of sheets resting upon floor 283. Alignment surfaces 286 are configured to linearly move to an extent so as to move the stack of sheets to a rearward position such that the rearward edges of the stack do not interfere with subsequent sheets placed on the stack and a forward position such that the stack of sheets may be positioned at the fastening position and at the folding position.

Side datum 287 comprises an elongate vertical surface generally extending along a side of floor 283. Side datum 287 provides a surface against which transverse edges of sheets received upon floor 283 may be properly oriented and aligned with respect to one another. In the example illustrated, side datum 287 comprises a vertical surface continuously extending alongside fastener 266 and folding rollers 272. In other embodiments, side datum 287 may comprise intermittently spaced vertical surfaces.

Alignment surface 288 (shown in FIG. 12) comprises a projection, set of tabs or fingers extending above floor 283 and actuatable towards and away from side datum 287. Alignment surface 288 is configured to engage transverse or side edges of sheets and to move such sheets against side datum 287 so as to transversely align the sheets in a stack.

Actuator 89 is described and illustrated with respect to FIG. 1. Actuator 89 comprises one or more actuators operably connected to alignment surfaces 284, 286 and 288 (shown in FIG. 12) so as to linearly move such surfaces for aligning sheets in a stack. Actuator 89 moves alignment surfaces 284, 26 and 288 in response to control signals received from a controller associated with an image forming device via a communication coupler 62 (shown and described with respect to FIG. 1). In other embodiments, actuator 89 may operate in response to control signals from a controller associated with booklet maker 214. In one embodiment, actuator 89 may comprise three solenoids connected to each of the alignment surfaces. In other embodiments, actuator 89 may comprise other mechanisms.

Torque source 260 comprises a source of torque for driving fastener 266, folding blade 268, folding rollers 272 and ejector 275 via actuator 270. In the example embodiment illustrated, torque source 260 comprises a motor such as a servo motor. In other embodiments, source 260 may comprise a stepper motor or other torque supplying devices.

Communication coupler 62 is illustrated and described above with respect to FIG. 1. Communication coupler 62 receives control signals from controller of an image forming device and transmits such control signals to torque source 260. Communication coupler 62 enhances coordination of image forming device and booklet maker 214. In addition, in particular embodiments, communication coupler 62 may reduce the size, complexity and cost of booklet maker 214 by reducing controllers associated with booklet maker 214.

Torque switching mechanism 264 selectively transmits torque from torque source 260 to fastener 266 or actuator 270. In the example illustrated, torque switching mechanism 264 includes worm gear 340, cluster gear 342 including gear 343 and gear 344, cluster gear 346 including gear 347 and another gear (not shown), gear 348, swing arm 350 and gear 352. Worm gear 340 is coupled to an output shaft of torque source 260 and is in meshing engagement with gear 343 of cluster gear 342. Gear 343 of cluster gear 342 is connected to gear 344. Gear 344 is in a meshing engagement with gear 347 of cluster gear 346. Gear 347 is connected to the other gear of cluster gear 346 gear (not shown) which is in meshing engagement with gear 348. Swing arm 350 comprises an elongate arm frictionally connected to gear 348 by a frictional clutch such that rotation of gear 348 results in rotation of gear 350. Swing arm 350 is coupled to gear 348 such that gear 348 may continue rotating and slipping relative to swing arm 350 when pivoting of swing arm 350 is obstructed such as when gear 352 is moved into engagement with either fastener 266 or actuator 270. Gear 352 is rotatably supported by swing arm 350 and is in meshing engagement with gear 348 so as to receive torque from gear 348. Gear 348 transmits torque to either fastener 266 or actuator 270 depending upon its position.

Fastener 266 comprises a mechanism configured to apply one or more fastening structures to a stack of sheets. In the illustrated, fastener 266 comprises a pair of staplers 360 supported by a shaft 362 which terminates at a gear 364. Staplers 360 comprise stapler cart ledges configured to apply staples to a stack of sheets in response to being rotated into engagement with the stack of sheets. In other embodiments, fastener 266 may comprise other staplers or other fastening devices. In other embodiments, fastener 266 may include fewer or greater than two such fastening devices.

Figure 12:
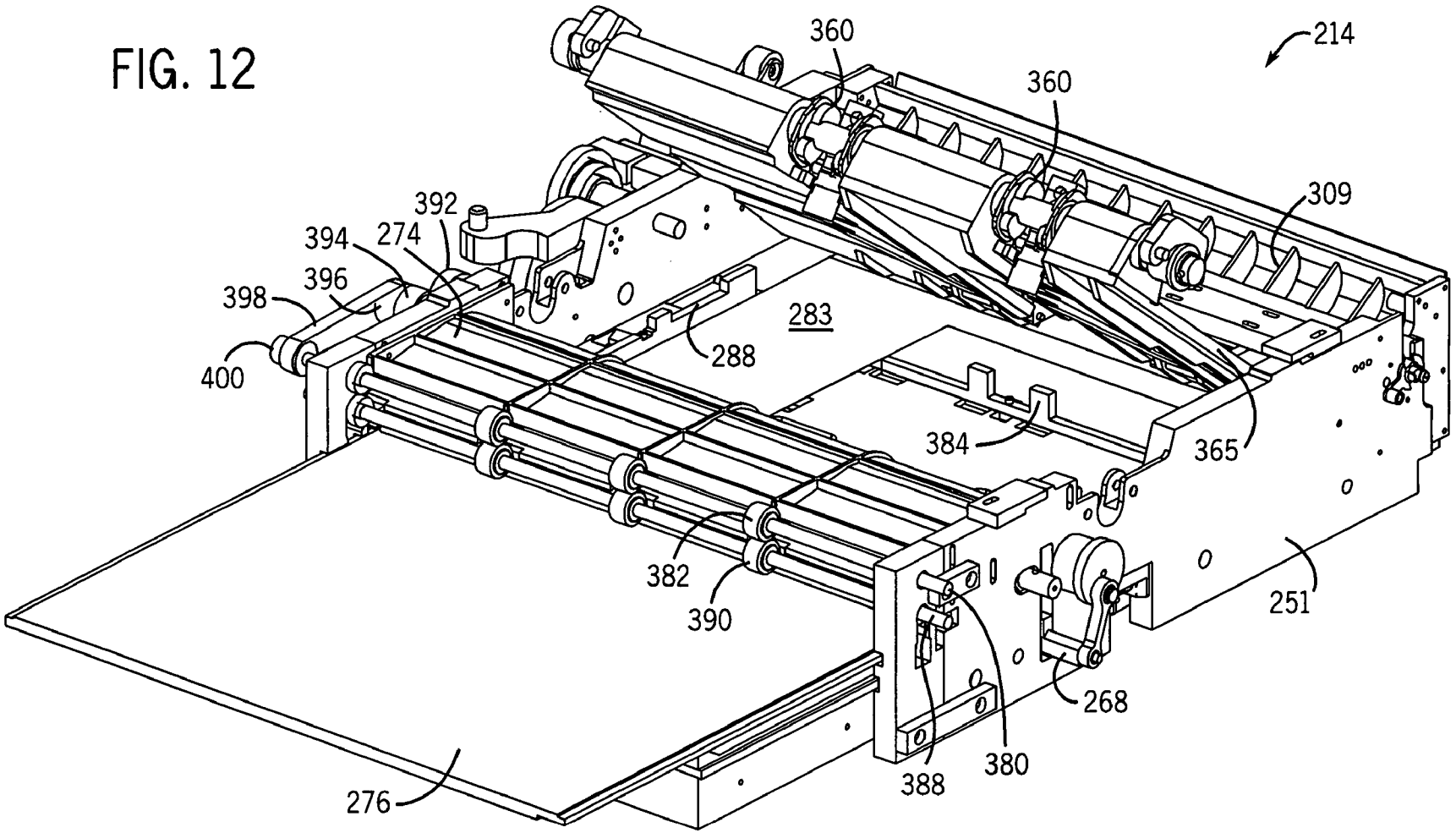
FIG. 12 is a top perspective view of the system of FIG. 10 illustrating pivoting of a fastener to a raised position according to one example embodiment.

In the embodiment illustrated, fastener 266 further includes support arms 365. Arms 365 have a first end rotatably connected to shaft 362 and a second end pivotally connected to frame 251. In the embodiment illustrated, arms 365 are pivotally connected to frame 251 by pins 366. In other embodiments, arms 365 may connected to frame 251 by other structures. Arms 365 permit fastener 266 to be pivoted away from floor 283 as shown in FIG. 12 to facilitate inspection and repair of fastener 266 and two further facilitate removal of jammed media. In other embodiments, fastener 266 may be supported relative to frame 251 and floor 283 in other manners.

Folding blade 268 comprises an elongate member extending opposite to the nip of folding rollers 272. Folding blade 268 reciprocates in a substantially vertical direction as indicated by arrows 367 from a position below floor 283 to a position above floor 283. In one embodiment, blade 268 comprises a continuous edge configured to engage an underside of a stack of sheets. In other embodiments, blade 268 may comprise transversely spaced tabs or fingers configured to intermittently engage an underlying surface of a stack of sheets.

Actuator 270 comprises a mechanism configured to reciprocate folding blade 268 and to also rotatably drive folding rollers 272. Actuator 270 generally includes gear 370, gear 372, link 374, and gear 376. Gear 370 is rotatably supported by frame 251 and is positioned such that swing arm 350 may be rotated to position gear 352 in meshing engagement with gear 370. Gear 372 is rotatably supported by frame 251 in meshing engagement with gear 370 and gear 376. Gear 372 is connected to one of folding rollers 272 such that rotation of gear 372 also results in rotation of one of folding rollers 272. Gear 372 is further connected to link 374. In the embodiment illustrated, gear 372 is coupled to link 374 by an intermediate disk 378. In other embodiments, link 374 may be directly connected to gear 372.

Link 374 comprises an elongate member having a first end rotatably coupled to gear 372 eccentric with respect to an axis about which gear 372 rotates. Link 374 has an opposite end rotatably coupled to folding blade 268. As a result, rotation of gear 372 results in folding blade 268 being reciprocated. Gear 376 is supported by frame 251 in meshing engagement with gear 372. Gear 376 is coupled to the other of folding rollers 272 such that rotation of gear 376 results in rotation of the other of folding rollers 272.

Folding rollers 272 comprise rollers rotatably supported by frame 251. Folding rollers 272 have ends connected to gears 372 and 376. Folding rollers 272 form a nip configured to receive fastened stack of sheets. Upon being rotated, folding rollers 272 fold the stack of sheets into a booklet which is moved into engagement with director 274.

Director 274 (shown in FIGS. 11 and 12) comprises an arcuate shaped structure or structures configured to engage the folded stack of sheets forming the booklet after the booklet has passed folding rollers. director 274 turns or bends the booklet so as to extend in a plane more parallel to floor 283. In the embodiment illustrated, director 274 turns the resulting booklet such as the booklet is ejected in a plane substantially parallel to floor 283.

Ejector 275 engages and grips the booklet and further moves the booklet to output 276 which comprises an output tray or bin. Ejector 275 generally includes ejector transmission 379, shaft 380, rollers 382, drive gears 384, 386, shaft 388 and rollers 390. Ejector transmission 378 transmits torque from actuator 370 to rollers 382 and 390. Ejector transmission 378 generally includes gear 392, gear 394, pulley 396, belts 398 and pulley 400. Gear 392 is rotatably supported by frame 251 in meshing engagement with gear 372 and a gear 394. Gear 394 is fixedly coupled to pulley 396 such that rotation of gear 394 results in rotation of pulley 396. Pulley 400 is fixedly coupled to shaft 380 such that rotation of pulley 400 results in rotation of shaft 380. Belt 398 extends between pulley 396 and pulley 400 to transmit torque from pulley 296 to pulley 402 and shaft 380. In other embodiments, ejector transmission 379 may include other arrangements such as a continuous gear train, a chain and sprocket arrangement or combinations thereof.

Shaft 380 is connected to pulley 400 and supports rollers 382 opposite to rollers 390. Shaft 380 is rotatably supported by frame 251 and is further connected to drive gear 384. Drive gear 384 is connected to shaft 380 as in meshing engagement with drive gear 386. Gear 386 is connected to shaft 388 and is in meshing engagement with drive gear 384 such that rotation of shaft 380 also results in rotation of shaft 388. Shaft 388 supports roller 390. As a result, rollers 382 and 390 receive a formed booklet and rotate so as to eject the formed booklet.

In operation, torque coupler 256 receives torque from an adjacent image-forming device and utilizes the torque to drive transport 254 so as to move a received sheet to aligner 358. Alignment surfaces 384, 386 and 388 of aligner 358 cooperate to receive and align multiple sheets into a stack. Alignment surfaces 384 further move the formed stack to the fastening position in which the sheet is positioned opposite to fastener 266. Once the stack of sheets are in the fastening position (schematically shown in FIG. 6), torque source 260 rotates its output shaft in an appropriate direction such that swing the arm 350 rotates in a clockwise direction to position gear 352 into engagement with gear 364 and drives gears 352 and 364 to rotate shaft 362 in a counter-clockwise direction to move staplers 360 into engagement with the stack of media to fasten or staple the stack of media.

After the stack of sheets has been fastened, alignment surface 284 is moved to move the stack of sheets to a folding position in which the stack is positioned opposite the nip of folding rollers 272. Torque source 260 rotates in an opposite direction to pivot swing arm 350 in a clockwise direction so as to move gear 352 to the position shown in FIG. 11 in which gear 352 is in engagement with gear 370 of actuator 270. Torque supplied by torque source 260 is transmitted by gear 352 to gear 370 to rotate gear 372 which results in folding blade 268 being reciprocated in a substantially vertical direction as shown in solid lines and in phantom in FIG. 11. Rotation of gear 370 further results in torque being transmitted to folding rollers 272 to fold the stack of sheets after the stack of sheets has been lifted into the nip by folding blade 268. Rotation of gear 370 also results in torque being transmitted to rollers 382, 390 by transmission 379 to eject the completed booklet to output 276.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

an image forming device having a first torque source and a first torque coupler rotatably driven by the first torque source;

a booklet maker removably coupled to the image-forming device and configured to receive sheets from the image-forming device, the booklet maker including:

a sheet moving mechanism;

a second torque coupler in removable engagement with the first torque coupler, wherein the sheet moving mechanism receives torque from the first torque source via the first torque coupler and the second torque coupler;

a first alignment surface; and a second alignment surface configured to move relative to the first alignment surface to align multiple sheets;

a multiple sheet fastener; and a folding blade, wherein the second alignment surface is configured to move aligned multiple sheets to a first position opposite the fastener and a second position opposite the folding blade.

2. The apparatus of claim 1, wherein the booklet maker further comprises:

folding rollers; and a second torque source, wherein the second torque source is coupled to at least two of the fastener, the folding rollers and the folding blade so as to actuate the at least two of the fastener, the folding rollers and the folding blade.

3. The apparatus of claim 2, wherein the second torque source is selectively coupled to the fastener and the folding blade.

4. The apparatus of claim 3, wherein the booklet maker further comprises:

a first gear connected to the fastener;

a second gear operably coupled to the folding rollers; and a swing arm carrying a third gear, wherein the third gear is configured to be rotated by the second torque source and wherein the swing arm is configured to move between a first position in which the third gear is operably coupled to the first gear and a second position in which a third gear is operably coupled to the second gear automatically in response to a change in direction of the second torque source using torque from the second torque source.

5. The apparatus of claim 4, wherein the second gear is operably coupled to the folding blade such that rotation of the second gear reciprocates the folding blade.

6. The apparatus of claim 2, wherein the second torque source is configured to actuate each of the fastener, the folding rollers and the folding blade.

7. The apparatus of claim 2, wherein the folding blade is configured to reciprocate in a substantially vertical direction and wherein the booklet maker further includes a diverter redirecting folded sheets in a substantially horizontal direction.

8. The apparatus of claim 1, wherein the booklet maker underlies the image-forming device.

9. The apparatus of claim 1, wherein the booklet maker is less than or equal to about 5 inches high.

10. A booklet maker comprising:

a fastener;

rollers; a blade; and a torque source coupled to at least two of the fastener, the rollers and the blade to actuate the at least two of the fastener, the rollers and the blade;

a first gear connected to the fastener;

a second gear operably coupled to the folding rollers; and a swing arm carrying a third gear, wherein the third gear is configured to be rotated by the torque source and wherein the swing arm is configured to move between a first position in which the third gear is operably coupled to the first gear and a second position in which the third gear is operably coupled to the second gear automatically in response to changing direction of the torque source using torque from the torque source.

11. The booklet maker of claim 10, wherein the second gear is operably coupled to the folding blade such that rotation of the second gear reciprocates the folding blade.

12. The booklet maker of claim 10, wherein the fastener is horizontally offset from the folding blade, wherein the folding blade is configured to reciprocate in a substantially vertical direction and wherein the booklet maker further includes a diverter redirecting folded sheets in a substantially horizontal direction.

13. The booklet maker of claim 10, wherein the multiple sheet fastener, the folding rollers, the folding blade and the torque source form a unit having a high less than or equal to about 5 inches.

14. The booklet maker of claim 13, wherein the unit is configured to be releasably connected to an image forming device.

15. The booklet maker of claim 10 further comprising:

a first alignment surface; and a second alignment surface configured to move relative to the first alignment surface to align multiple sheets.

16. The booklet maker of claim 10 further comprising:

a first alignment surface; and a second alignment surface configured to move relative to the first alignment surface to align multiple sheets, wherein the second alignment surface is configured to move aligned multiple sheets to a first position opposite the fastener and a second position opposite the blade and wherein the second alignment surface is configured to move aligned multiple sheets to a first position opposite the fastener and a second position opposite the blade.

17. An apparatus comprising:

an image forming device having a first torque source and a first torque coupler rotatably driven by the first torque source;

a booklet maker removably coupled to the image-forming device and configured to receive sheets from the image-forming device, the booklet maker including:

a sheet moving mechanism;

a second torque coupler in removable engagement with the first torque coupler, wherein the sheet moving mechanism receives torque from the first torque source via the first torque coupler and the second torque coupler;

a multiple sheet fastener;

folding rollers;

a folding blade; and a second torque source, wherein the second torque source is coupled to at least two of the fastener, the folding rollers and the folding blade so as to actuate the at least two of the fastener, the folding rollers and the folding blade, wherein the folding blade is configured to reciprocate in a substantially vertical direction and wherein the booklet maker further includes a diverter redirecting folded sheets in a substantially horizontal direction.

18. An apparatus comprising:

an image forming device;

a booklet maker removably coupled to the image-forming device and configured to receive sheets from the image-forming device, the booklet maker including:

a sheet moving mechanism;

a multiple sheet fastener;

folding rollers;

a folding blade, wherein the booklet maker underlies the image forming device;

a first alignment surface; and a second alignment surface configured to translate relative to the first alignment surface to align multiple sheets wherein the second alignment surface is configured to move aligned multiple sheets to a first position opposite the multiple sheet fastener and from a first position to a second position of opposite the folding blade.

19. The apparatus of claim 18 further comprising:

a torque source coupled to at least two of the multiple sheet fastener, the folding rollers and the folding blade to actuate the at least two of the multiple sheet fastener, the folding rollers and the folding blade;

a first gear connected to the multiple sheet fastener;

a second gear operably coupled to the folding rollers; and a swing arm carrying a third gear, wherein the third gear is configured to be rotated by the torque source and wherein the swing arm is configured to move between a first position in which the third gear is operably coupled to the first gear and a second position in which a third gear is operably coupled to the second gear automatically in response to changing direction of the torque source using torque from the torque source.

* * * * *

UNITED STATES PATENT AND TRADEMARK OFFICE

CERTIFICATE OF CORRECTION

PATENT NO. : 7,530,559 B2
APPLICATION NO. : 11/402424
DATED : May 12, 2009
INVENTOR(S) : Abdolreza Movaghar et al.

It is certified that error appears in the above-identified patent and that said Letters Patent is hereby corrected as shown below:

In column 8, line 51, delete "10" and insert -- 110 --, therefor.

In column 16, line 36, in Claim 18, delete "sheets" and insert -- sheets, --, therefor.

In column 16, line 40, in Claim 18, after "position" delete "of".

Signed and Sealed this

Tenth Day of November, 2009

David J. Kappos

David J. Kappos
*Director of the United States Patent and Trademark Office*